United States Patent [19]

Vento

[11] Patent Number: 5,024,436

[45] Date of Patent: Jun. 18, 1991

[54] BASEBALL BAT EXERCISING DEVICE

[76] Inventor: Sammy J. Vento, 8401 Sterling Ave., Raytown, Mo. 64138

[21] Appl. No.: 577,562

[22] Filed: Sep. 5, 1990

[51] Int. Cl.[5] ..... A63B 69/00

[52] U.S. Cl. ..... 273/26 R

[58] Field of Search ..... 273/26 B, 72 R, 26 R, 273/183 D, 186 R, 186 A, 186 C, 186 D, 193 A, 194 B

[56] References Cited

U.S. PATENT DOCUMENTS

| | | | |
|---|---|---|---|
| 2,244,972 | 6/1941 | Stumpf | 273/186 A |
| 2,780,098 | 5/1957 | Maroth | 273/186 A |
| 3,113,782 | 12/1963 | Guier | 273/186 A |
| 3,136,546 | 6/1964 | Conolly | 273/186 A |
| 3,508,748 | 4/1970 | Stimel | 273/194 B |
| 3,971,559 | 7/1976 | Diforte, Jr. | 273/194 B |
| 4,634,121 | 1/1987 | Sasaki | 273/194 B |

*Primary Examiner*—Theatrice Brown

*Attorney, Agent, or Firm*—H. Jay Spiegel

[57] ABSTRACT

The present invention relates to an improved baseball bat exercising device. The exercising device includes a sleeve that is designed to fit over a baseball bat, the sleeve having a spring-weight assembly thereon which moves longitudinally along the sleeve when the bat is swung. The inventive device also includes a metering system which indicates to a user the relative power expended when the baseball bat having the exercise device thereon is swung.

8 Claims, 3 Drawing Sheets

BASEBALL BAT EXERCISING DEVICE

BACKGROUND OF THE INVENTION

The present invention relates to a baseball bat exercising device. The exercising device includes a sleeve having a weight therewith, the movement of the weight indicating the power in a person's swing of a baseball bat. In the prior art, devices in combination with baseball bats are known The following prior art is known to Applicant:

U.S. Pat. No. 3,173,688 to Green discloses the concept of a novelty device which includes a baseball bat having a sounding means therein to simulate the sound of a bat striking a ball when swung. The teachings of Green are different from that of the present invention, in that Green does not teach or suggest a baseball bat exercising device which includes a sleeve and weight assembly designed to improve one's baseball swing.

U.S. Pat. No. 3,578,801 to Piazza discloses the concept of a hollow baseball bat having internal structure which is designed to increase the inertia of the bat during the swing. Piazza is different from the teachings of the present invention in that Piazza fails to teach or fairly suggest a baseball bat exercising device which is designed to be secured to the outside of a bat and is adaptable to different sized baseball bats.

U.S. Pat. No. 4,267,793 to Lane et al. discloses the concept of a baseball bat having an internal structure which is designed to indicate the velocity of a baseball bat when swung. Again, the teachings of Lane et al. are different from that of the present invention in that Lane et al. does not disclose or suggest a baseball bat exercising device designed to be slid over a baseball bat and to be used to practice baseball bat swinging.

SUMMARY OF THE INVENTION

The present invention relates to a baseball bat exercising device. The present invention includes the following interrelated aspects and features:

(A) In a first aspect, the baseball bat exercising device includes a hollow sleeve which is designed to be slid over the handle portion of the baseball bat and engage a portion of the baseball bat remote from the handle end.

(B) Mounted on the sleeve is a spring-weight assembly which is designed to slide along the length of the sleeve when the bat is swung. The spring-weight assembly is secured to the sleeve by a plurality of coil springs which provide tensile forces to hold the spring-weight assembly in place as well as resistance when the weight moves along the sleeve when the bat is swung.

(C) The sleeve also includes a plurality of notches therein which may be utilized in conjunction with the spring weight assembly to indicate the distance the weight has travelled as well as the power in the baseball bat swing.

(D) The sleeve also includes an end cutout portion which facilitates engaging the sleeve in place on a baseball bat.

Accordingly, it is a first object of the present invention to provide an improved baseball bat exercising device.

It is a yet further object of the present invention to provide a baseball bat exercising device which includes a weighted assembly which provides exercise during swinging of a baseball bat.

It is a still further object of the present invention to provide a baseball bat exercising device which includes a metering feature which indicates the relative power used during swinging of a baseball bat.

These and other objects, aspects and features of the present invention will be better understood from the following detailed description of the preferred embodiments when read in conjunction with the appended drawing figures.

SPECIFIC DESCRIPTION OF THE PREFERRED EMBODIMENT

Figure 1:
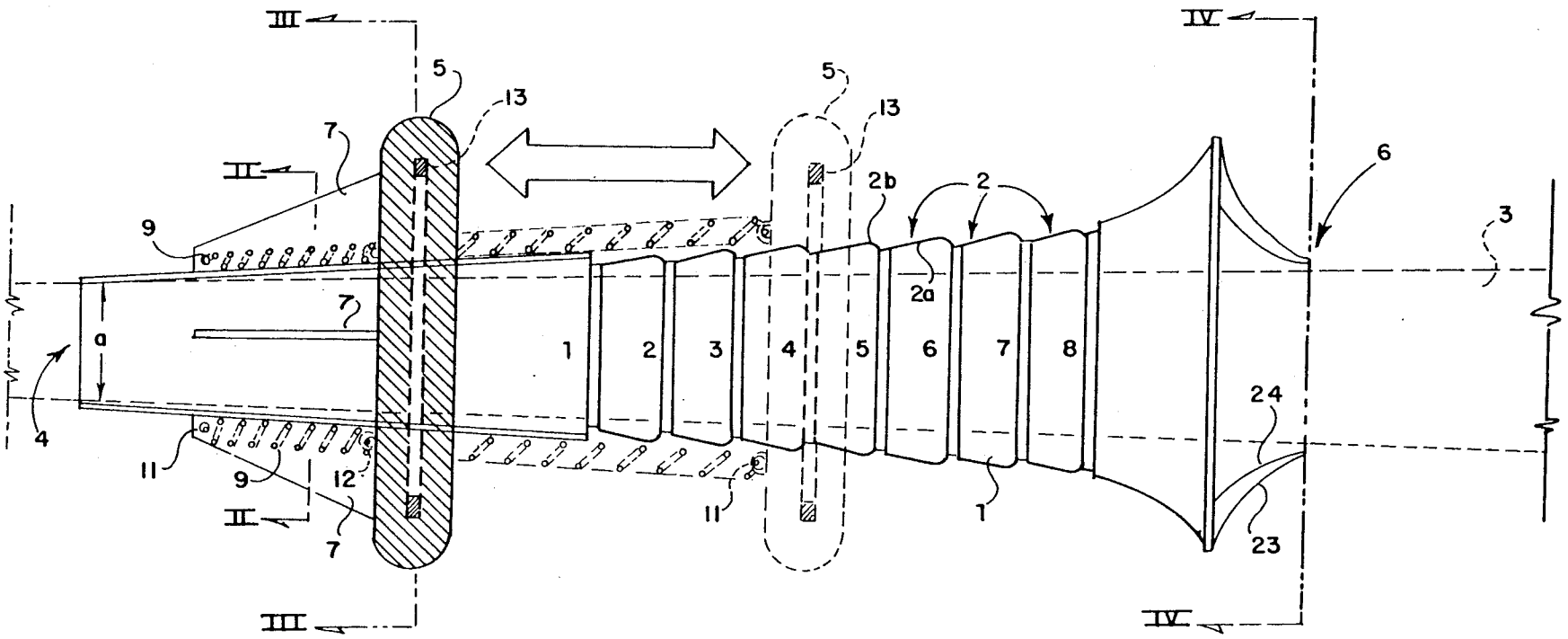
FIG. 1 shows a side view of the baseball bat exercising device.

With reference, firstly, to FIG. 1, the present invention is generally designated by the reference numeral 10 and is seen to include a tapered sleeve 1 engaging a baseball bat 3. The tapered sleeve 1 is designed to be inserted over the handle end of the baseball bat 3 and slid along the baseball bat 3 such that the tapered sleeve engages the baseball bat above the gripping portion of the baseball bat.

Figure 2:
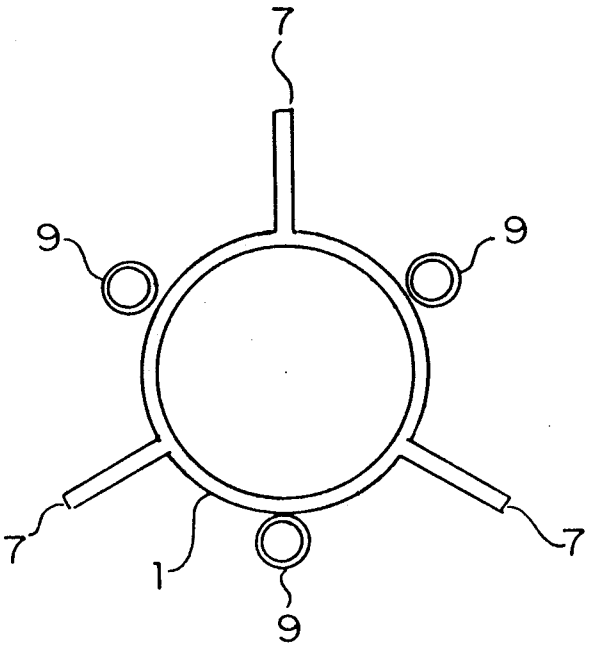
FIG. 2 shows a cross-sectional view along the line II—II of FIG. 1.

With reference to FIGS. 1 and 2, located on the outer surface of the tapered sleeve 1 are a plurality of stops 7 and an annular weight 5. The annular weight 5 is attached to the sleeve by a plurality of springs 9, the springs 9 being attached at one end to the sleeve by use of the rings 11 and at the other end to the annular weight 5 by the rings 12. The springs 9 provide a resistance against movement of the annular weight 5 along the sleeve when the bat 3 is swung.

Figure 3:
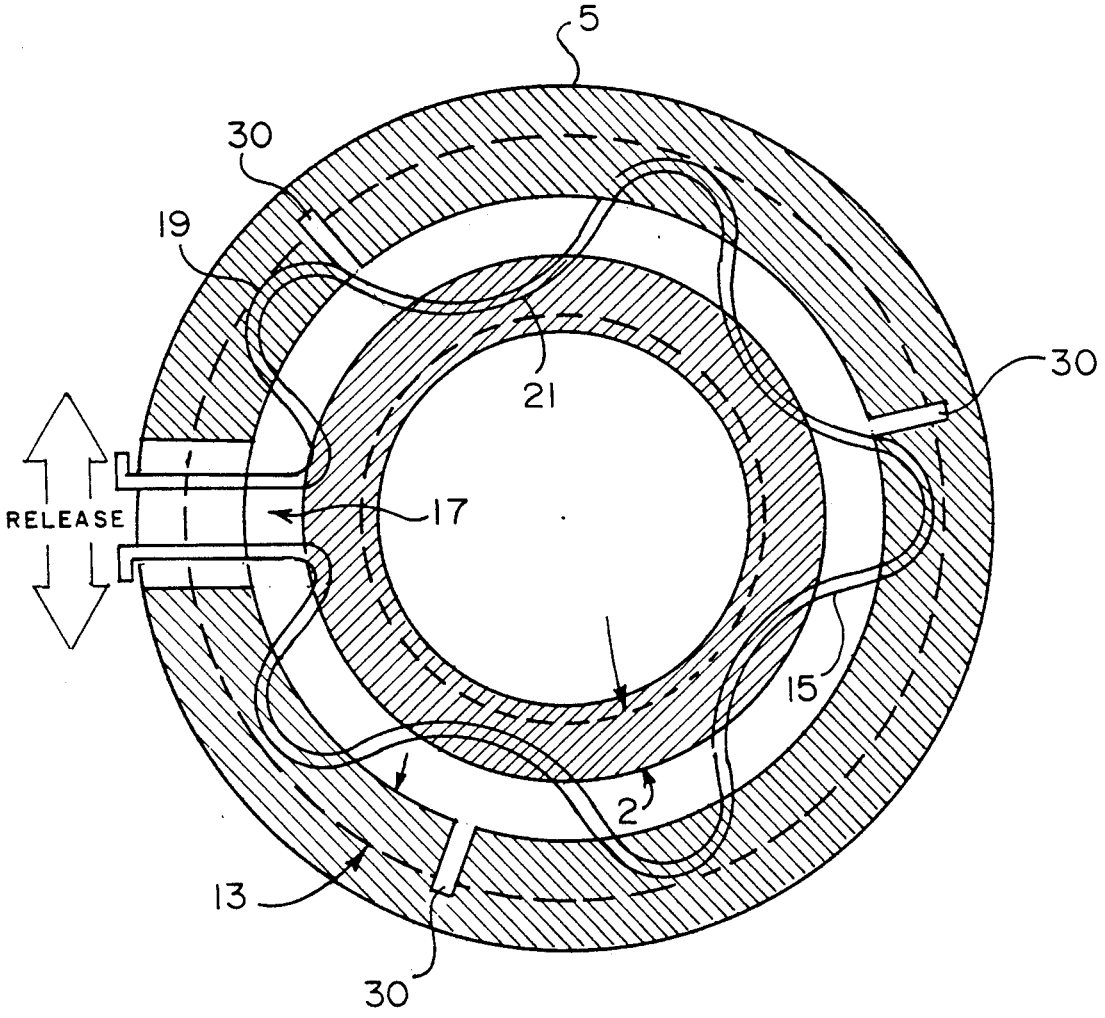
FIG. 3 shows a cross-sectional view along the line III—III of FIG. 1.

With reference to FIGS. 1 and 3, the annular weight 5 includes a circumferential groove 13 along the inner face thereof. Located within the annulus of the weight 5 and around the periphery of the sleeve 1 is a peripheral spring 15. The peripheral spring 15 includes a plurality of first curved portions 19 which engage the groove 13 of the annular weights 5 and a plurality of second curved portions 21 which are designed to engage the circumferential slots 2 on the sleeve 1. Each slot 2 has a taper **2*a* which facilitates the annular weight traveling outwardly along the sleeve 1 without catching on a given slot until the annular weight has stopped traveling. Once the weight stops traveling, the spring will pull the weight back so as to catch the weight in the portion 2*b* of a given slot. The peripheral spring 15 has a gap 17 therein which permits the spring to adjust to the increasing diameter of the sleeve 1. The peripheral spring 15 also centers the annular weight 5 on the sleeve during use. The combination of the annular weight 5 and the peripheral spring 15 provides a metering system to indicate the relative power used during the swinging of the baseball bat 3**.

In an alternative embodiment, the metering means may include a pair of stops which are mounted to the outer surface of the annular weight 5, the stops designed to engage the slots 2 using spring biasing means. The stops may be semicircular in shape and have a thickness approximating the width of the slots 2. The stops may also include leg means thereon which may be clamped together so as to overcome the spring biasing means and permit the weight to slide along the length of the sleeve without the stops engaging any of the circumferential slots 2.

Figure 4:
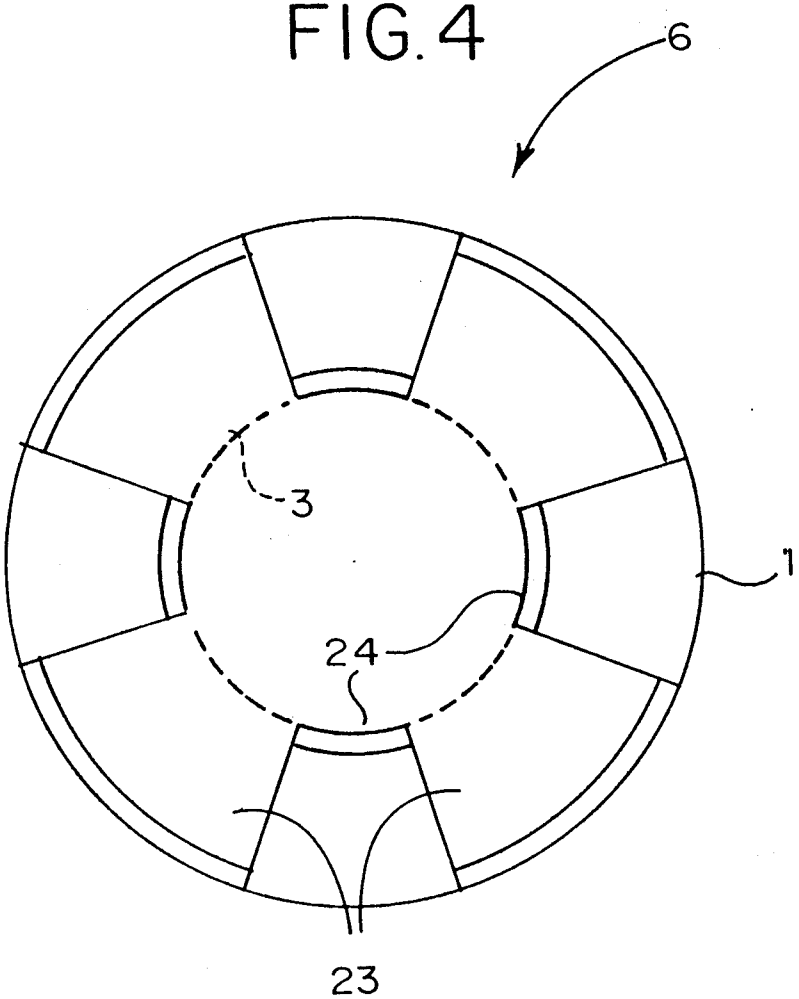
FIG. 4 shows an end view along the line IV—IV of FIG. 1.

With reference to FIGS. 1 and 4, the end portion 6 of the sleeve 1 includes a plurality of segments 23. Each segment 23 includes an edge 24 which is designed to engage the surface of a bat and retain the sleeve in place when in use.

In use, the end portion 6 of the sleeve 1 is slid over the butt end of a bat 3. The sleeve opening 4 should have a diameter A which permits the sleeve to pass over the butt end of the bat handle and engage the bat above the gripping portion thereof. With the spring-weight assembly resting against the stop 7, the bat is swung and the weight is pushed outwardly along the sleeve, proportionately to the power of the swing. When the weight slows down, the peripheral spring 15 can engage one of the circumferential slots 2 on the sleeve 1, thereby retaining the weight in an extended position. A user can then relatively gauge the power of the user's swing by the numbered slot the spring within the annular weight engages, the higher the numbered slot, the more power in the swing.

Alternatively, the weight may be removed from the sleeve by detaching the springs connected thereto and rotating the weight 5 so as to line the stop 7 with the recesses 30 in the weight. The weight may then be slid off the sleeve, the spring removed, and the weight reinserted on the sleeve and reattached to the springs 9 so as to use the exercising device without the metering system.

The inventive exercising device may be made out of any materials, with a preferred material being plastic. The annular weight may also be made out of any materials, either metallic or non-metallic. Additionally, a plurality of weights may be provided, each weight having a different mass. For example, a one, two, and three-pound weight may be provided for use in the inventive device. Furthermore, although three springs are shown connecting the annular weight to the sleeve, more or less springs may be used, depending upon the desired tension. Furthermore, different sized springs with different tensions may be utilized depending on the size of the particular user. For example, an adult may require more and larger springs to provide resistance against movement of the weight, with a small child requiring a lesser number of springs and/or smaller diameter springs.

The inventive baseball bat exercising device provides improvements over other prior art devices in that the exercising device may be utilized with different sized bats. Furthermore, different sized annular weights as well as springs may be utilized to match the requirements of individual users. Additionally, the inventive device provides a metering system which permits a user to monitor the power in the user's baseball swing.

As such, an invention has been disclosed in terms of a preferred embodiment thereof which fulfills each and every one of the objects of the invention as set forth hereinabove and provides a new and improved baseball bat exercising device of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

I claim:

1. A baseball bat exercising device comprising:

(a) a sleeve having a generally cylindrical shape, said sleeve being sized to circumferentially engage a portion of a baseball bat;

(b) an annular weight, said annular weight being sized to surround said sleeve; and (c) means to removably connect said annular weight to said sleeve and provide a resistive force against said annular weight traveling longitudinally along said sleeve, (d) whereby said annular weight travels longitudinally along said sleeve when a said baseball bat is swung by a user and provides exercise for said user.

2. The invention of claim 1, wherein said sleeve is tapered in length.

3. The invention of claim 1, further including stop means located on said sleeve, said stop means being adapted to engage and hold said annular weight at a location on said sleeve.

4. The invention of claim 1, further including metering means to measure relative power in a swing of a said baseball bat.

5. The invention of claim 4, said metering means further comprising:

(a) a plurality of slots in said sleeve; and (b) spring means being attached to said annular weight and being adapted to engage a said slot on said sleeve, (c) whereby said annular weight is adapted to be aligned with a said slot during swinging of a said bat so as to indicate to a user a measurement of swinging power.

6. The invention of claim 5, wherein each said slot is circumferentially tapered so as to permit said annular weight to travel outwardly along said sleeve.

7. The invention of claim 1, wherein said sleeve includes an end portion having a plurality of prongs thereon, said prongs designed to engage a portion of a baseball bat surface and retain said sleeve on said baseball bat.

8. The invention of claim 1, wherein said sleeve is made of plastic.

* * * * *